US009394763B2

(12) United States Patent
Wolf et al.

(10) Patent No.: US 9,394,763 B2
(45) Date of Patent: Jul. 19, 2016

(54) MULTILATERAL LOCATION AND ORIENTATION ASSEMBLY

(75) Inventors: John Wolf, Houston, TX (US); Michael Plooy, Calgary (CA); Victor Fridman, Calgary (CA); Hanif Hunter, Houston, TX (US); Barton Sponchia, Cypress, TX (US); Lance M. Rayne, Spring, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 880 days.

(21) Appl. No.: 13/562,452

(22) Filed: Jul. 31, 2012

(65) Prior Publication Data

US 2013/0192840 A1 Aug. 1, 2013

Related U.S. Application Data

(60) Provisional application No. 61/521,104, filed on Aug. 8, 2011.

(51) Int. Cl.
*E21B 41/00* (2006.01)
*E21B 47/024* (2006.01)

(52) U.S. Cl.
CPC ..... *E21B 41/0035* (2013.01); *E21B 47/024* (2013.01)

(58) Field of Classification Search
CPC ..... E21B 7/06; E21B 7/061; E21B 29/06; E21B 23/002; E21B 23/004; E21B 23/006; E21B 23/02; E21B 23/03; E21B 41/0035; E21B 47/024
See application file for complete search history.

(56) References Cited

U.S. PATENT DOCUMENTS

| | | | | | |
|---|---|---|---|---|---|
| 2,492,079 | A | * | 12/1949 | Wiley | 166/117.5 |
| 4,094,360 | A | | 6/1978 | Nelson | |
| 4,537,429 | A | * | 8/1985 | Landriault | 285/334 |
| 5,564,503 | A | * | 10/1996 | Longbottom | E21B 7/061 166/117.6 |
| 5,870,901 | A | * | 2/1999 | Kontos et al. | 62/238.3 |
| 5,915,474 | A | * | 6/1999 | Buytaert et al. | 166/50 |
| 6,012,527 | A | | 1/2000 | Nitis et al. | |
| 6,019,173 | A | * | 2/2000 | Saurer | E21B 7/061 166/117.6 |
| 6,510,898 | B1 | | 1/2003 | Buytaert | |
| 6,543,536 | B2 | | 4/2003 | Dewey et al. | |
| 2006/0145476 | A1 | * | 7/2006 | Reynolds | E21B 17/0423 285/333 |

OTHER PUBLICATIONS

International Search Report and Written Opinion, Application No. PCT/US2012/049293 filed Aug. 2, 2012, dated Feb. 13, 2013.

* cited by examiner

*Primary Examiner* — Cathleen Hutchins
*Assistant Examiner* — Ronald Runyan
(74) *Attorney, Agent, or Firm* — Michael Stonebrook

(57) ABSTRACT

A location and orientation assembly suitable for use in a multi-lateral wellbore may include a coupling portion, an upper muleshoe, a muleshoe spacer and a bottom muleshoe. The bottom muleshoe may connect to the coupling portion through a threaded connection. A method for locating and orienting in a multi-lateral wellbore includes providing a locating and orientation assembly. In the orientation assembly a coupling portion is provided and an upper muleshoe is inserted into the coupling portion. A muleshoe spacer is inserted into the coupling portion so as to matingly contact the upper muleshoe portion. Part of a bottom muleshoe is inserted into the coupling portion so as to matingly contact the muleshoe spacer. The coupling portion is jointed to the bottom muleshoe by a threaded connection.

40 Claims, 3 Drawing Sheets

MULTILATERAL LOCATION AND ORIENTATION ASSEMBLY

CROSS REFERENCE TO RELATED APPLICATION

The present document is based on and claims priority to U.S. Provisional Application Ser. No. 61/521,104, filed Aug. 8, 2011, incorporated herein by reference.

BACKGROUND

Hydrocarbon fluids such as oil and natural gas are obtained from a subterranean geologic formation, referred to as a reservoir, by drilling a well that penetrates the hydrocarbon-bearing formation. In some cases, a multilateral well system may be used where one or more lateral wells depart from the main wellbore. Once a wellbore is drilled, various forms of well completion components may be installed in order to control and enhance the efficiency of producing the various fluids from the reservoir. One piece of equipment which may be installed is a location and orientation assembly to help identify the location of the multi-lateral bores in relation to the main wellbore.

SUMMARY

In some embodiments, a location and orientation assembly suitable for use in a multi-lateral wellbore may include a coupling portion, an upper muleshoe, a muleshoe spacer and a bottom muleshoe. The bottom muleshoe may connect to the coupling portion through a threaded connection. In some embodiments, a method for locating and orienting in a multi-lateral wellbore includes providing a locating and orientation assembly. In the orientation assembly a coupling portion is provided and an upper muleshoe is inserted into the coupling portion. A muleshoe spacer is inserted into the coupling portion so as to matingly contact the upper muleshoe portion. Part of a bottom muleshoe is inserted into the coupling portion so as to matingly contact the muleshoe spacer. The coupling portion is jointed to the bottom muleshoe by a threaded connection.

BRIEF DESCRIPTION OF THE DRAWINGS

Certain embodiments will hereafter be described with reference to the accompanying drawings, wherein like reference numerals denote like elements. It should be understood, however, that the accompanying drawings illustrate only the various implementations described herein and are not meant to limit the scope of various technologies described herein. The drawings show and describe various embodiments of this disclosure.

DETAILED DESCRIPTION

Figure 1:
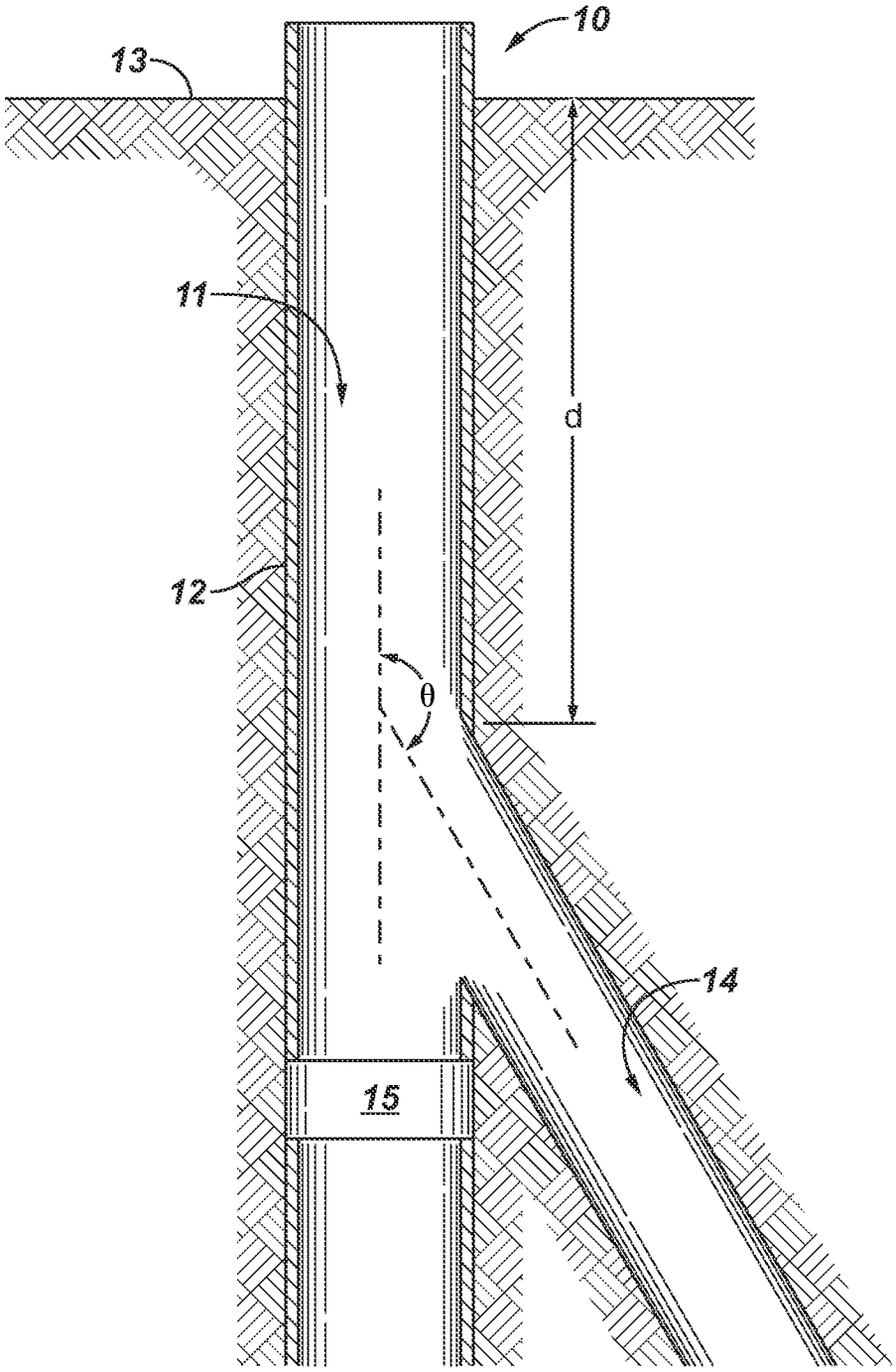
FIG. 1 is an illustration of an embodiment of a well system, according to an embodiment of the disclosure.

In the following description, numerous details are set forth to provide an understanding of the present invention. However, it will be understood by those skilled in the art that the present invention may be practiced without these details and that numerous variations or modifications from the described embodiments may be possible.

In the specification and appended claims: the terms "connect", "connection", "connected", "in connection with", and "connecting" are used to mean "in direct connection with" or "in connection with via one or more elements"; and the term "set" is used to mean "one element" or "more than one element". Further, the terms "couple", "coupling", "coupled", "coupled together", and "coupled with" are used to mean "directly coupled together" or "coupled together via one or more elements". As used herein, the terms "up" and "down", "upper" and "lower", "upwardly" and downwardly", "upstream" and "downstream"; "above" and "below"; and other like terms indicating relative positions above or below a given point or element are used in this description to more clearly describe some embodiments. However, when applied to equipment and methods for use in environments that are deviated or horizontal, such terms may refer to a left to right, right to left, or other relationship as appropriate.

In some instances, a multi-lateral well includes a parent wellbore and one or more lateral wellbores that extend from the parent wellbore. In some cases, a main parent casing string lines the parent wellbore; and liner string(s) hang from the parent casing string and extend from the parent wellbore into the lateral wellbore(s).

For purposes of creating a multi-lateral well, the parent wellbore may be first drilled and then cased with a casing string. A particular lateral wellbore may then be established by first milling a window (called a "parent casing window") out of the wall of the parent casing string. The parent casing window forms the entry point of the lateral wellbore from the parent wellbore. After the lateral wellbore is drilled, a lateral liner string may be run downhole so that the liner string hangs from the parent casing string and extends into the lateral wellbore. Depending on the particular multi-lateral system, the liner string may be cemented in place inside the parent casing string and/or may be sealed to the parent casing string. Again depending on the particular multi-lateral system, additional completion components may later be run into the lateral wellbore.

In some cases, several operations may be necessary to properly create and complete the lateral wellbore. For instance, one set of tooling may be used to mill the parent casing window and another may be necessary to mill the lateral wellbore. Likewise, the equipment or tooling used to run the lateral liner string may be different from the equipment or tooling used to cement or complete the lateral wellbore. In each of the operations the location of the lateral wellbore must be accurately identified with respect to the parent wellbore, so that the equipment or tooling may leave the parent wellbore, enter the lateral wellbore, and perform the necessary operation. The identification of the parent to lateral wellbore junction typically needs to be identified both longitudinally (i.e. depth from surface or along the parent wellbore length) and azimuthally (i.e. azimuthally from the wellbore's centerline).

Referring to FIG. 1, a multi-lateral subterranean well system 10 is shown. A parent wellbore 11 that is lined by a parent casing string 12 extends downhole from the well surface 13. A lateral bore 14 is shown drilled, but not cased, departing from the parent wellbore at a depth d, and azimuthally oriented from the parent wellbore 11 centerline at angle θ. For purposes of identifying the lateral bore 14 with respect to the parent wellbore 11 (e.g. depth d and angle θ), the well system 10 may include a location and orientation assembly 15, that is deployed as part of the casing 12. Location and orientation assembly 15 may be used as a permanent reference point within the well system 10, so as to define a point which equipment or tooling may repeatedly return to, and from which the distance (longitudinal or azimuthally) to the lateral bore departure point.

It is noted that the well system 10 show in FIG. 1 is simplified for clarifying the following description. Thus, the well system 10 may have other and different features than those shown. For example, a well system may include multiple lateral wellbores and liner or casing strings. Likewise while the orientation assembly 15 is shown in FIG. 1 as part of the casing 12 below the lateral bore 14, in other systems the orientation device 15 may be deployed as part of the casing 12 above the lateral bore 14.

Figure 2:
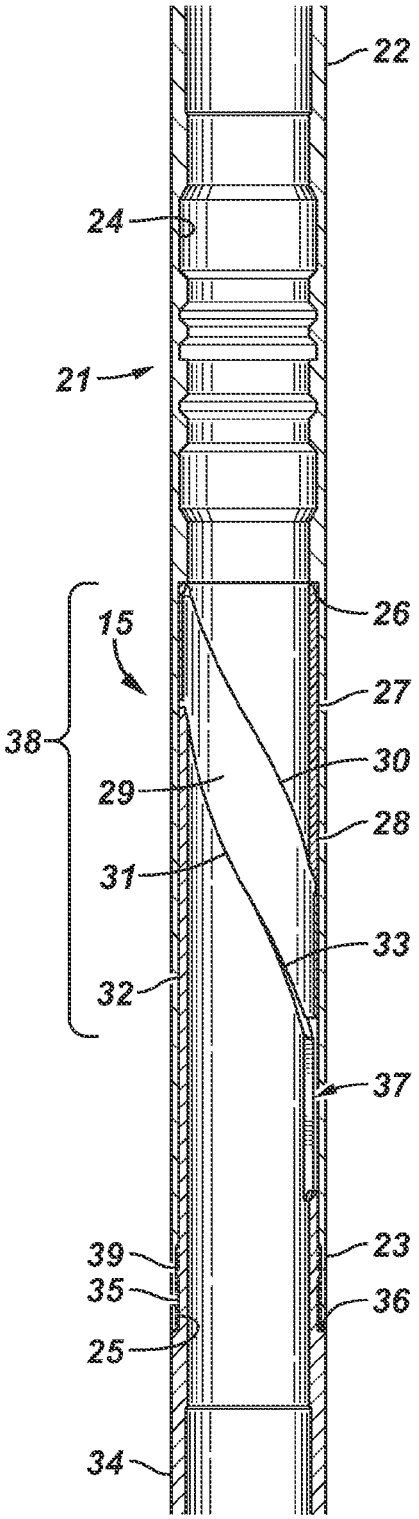
FIG. 2 is an illustration of an embodiment of an orienting assembly, according to an embodiment of the disclosure.

Referring now to FIG. 2, an embodiment of an orientation assembly 15 is shown in section view. The orientation assembly 15 comprises a coupling portion 21 which has first and second ends (22, 23). When orientation assembly 15 is deployed as part of a casing string in a well, for example in parent wellbore 11, the first end 22 of coupling portion 21 is suitable to attach to casing 12 so as to form a continuous extension of the casing 12 deployed in the parent wellbore 11. In some embodiments the outer diameter of the orientation assembly 15 and the coupling portion 21 in particular is substantially the same as that of the casing 12. The inner surface of the coupling portion 21 may have a landing profile 24 cut into it, the landing profile 24 suitable to land or engage a tool which may pass through the orientation assembly 15. Landing profile 24 may engage a passing tool through a typical "lock and key" or "collet and finger" approach as used in other downhole tools. The second end 23 of the coupling portion 21 is threaded 25 portion, and in some embodiments has female type threading disposed thereon. At some point between first and second ends (22, 23) the coupling section 21 has a first internal shoulder portion 26. In some embodiments, the first internal shoulder is located after the landing profile 24 section, but before the threaded portion 25.

Orientation assembly 15 also comprises an upper muleshoe 27. While upper muleshoe 27 is a separate piece from coupling portion 21, when utilized in the orientation assembly 15, upper muleshoe 27 is disposed within coupling portion 21. For example, during make-up of orientation assembly 15, upper muleshoe 27 may be inserted into coupling portion 21 from second end 23, and run into the coupling portion 21 towards the first end 22, until upper muleshoe 27 is stopped by, or abuts, first internal shoulder 26. The second end 28 of upper muleshoe 27, which is opposite of the end that abuts first internal shoulder 26, may be at least partially helical in orientation.

With continued reference to FIG. 2, in some embodiments orientation assembly 15 may also comprise a muleshoe spacer 29. While muleshoe spacer 29 is a separate piece from coupling portion 21 and upper muleshoe 27, when utilized in the orientation assembly 15, muleshoe spacer 29 is disposed within the coupling portion 21. Muleshoe spacer 29 has a first end 30 and a second end 31, both of which may be at least partially helical in orientation, although the helical orientation of the first end 30 does not necessarily have to be the same as the helical orientation of the second end 31. The helical orientation of muleshoe spacer first end 30 is substantially similar to that of the upper muleshoe end 28, such that when muleshoe spacer 29 is inserted into coupling portion 21 from its second end 23 and run into the coupling portion 21 towards its first end 22, the muleshoe spacer 29 may matingly contact the upper muleshoe 27, such that upper muleshoe second end 28 may be in contact with muleshoe spacer first end 30 along the entire length of both ends.

The orientation assembly 15 also comprises a bottom muleshoe 32 which has first and second ends (33, 34). When orientation assembly 15 is deployed as part of a casing string in a well, for example in the parent wellbore 11, the second end 34 of bottom muleshoe 32 is suitable to attach to the rest of the casing 12 so as to form a continuous extension of the casing 12 deployed in the parent wellbore 11. In some embodiments the outer diameter of the orientation assembly 15 and the bottom muleshoe 32 in particular is substantially the same as that of the casing 12.

While bottom muleshoe 32 is a separate piece from coupling portion 21, upper muleshoe 27 and muleshoe spacer 29, when utilized in the orientation assembly 15, bottom muleshoe is at least partially disposed within coupling portion 21. In particular, first end 33 of bottom muleshoe 32 may be disposed within coupling portion 21. First end 33 of bottom muleshoe 32 may also have an at least partially helical orientation. The helical orientation of first end 33 is substantially similar to that of the muleshoe spacer second end 31, such that when bottom muleshoe 32 is inserted into coupling portion 21 from its second end 23 and run into the coupling portion 21 towards its first end 22, the bottom muleshoe first end 33 may matingly contact muleshoe spacer second end 31, such that the first end 33 may be in contact with the second end 31 along the entire length of both ends.

Bottom muleshoe 32 also has a threaded portion 35 so that bottom muleshoe 32 may be threadably connected to coupling portion second end 23. For instance, in embodiments where coupling portion 21 has female type threading 25 disposed thereon, bottom muleshoe threaded portion 35 may be male threading, and the reverse case may also be true (e.g. female threads on bottom muleshoe 32 when there are male threads on coupling portion 21). In some embodiments, coupling portion 21 is threaded onto bottom muleshoe 32 using a buttress type casing connection. In some embodiments, a sealing element 39 may be disposed between coupling portion 21 and bottom muleshoe 32, typically prior to the threaded portion interface between threaded portions 25 and 35. Sealing element 39 may be a conventional type downhole seal element and may be used to ensure the fluidic integrity of orientation assembly 15.

Also in some embodiments, the coupling portion 21 connection to bottom muleshoe 32 comprises a torque shoulder 36 that controls the make-up distance between components in the orientation assembly 15 to ensure there is minimal freedom of movement between the upper muleshoe 27, the muleshoe spacer 29 and bottom muleshoe 32. Torque shoulder 36 may abut with coupling portion second end 23. Bottom muleshoe 32 may also comprise a receiving slot 37, the receiving slot located between the bottom muleshoe first end 33 and torque shoulder 36.

In some embodiments, the orientation assembly 15 also comprises an orienting profile 38 which is disposed on the interior of the assembly and which is suitable to azimuthally orient a tool passing through the assembly 15. As discussed previously in connection with FIG. 1, azimuthally orienting a passing tool may help enable the identification of the parent to lateral wellbore junction, particularly as between multiple tool runs in the well.

Orienting profile 38 may be formed by the interfacing of the upper muleshoe 27, the muleshoe spacer 29 and the bottom muleshoe 32. In particular, when these components are properly aligned and installed in the orientation assembly 15 (e.g. minimal freedom of movement therebetween) the orienting profile 38 is formed by the interfacing of the helical orientations of the various aforementioned ends of the upper muleshoe 27, the muleshoe spacer 29 and the bottom muleshoe 32, and by a variation in thickness between the muleshoe spacer 29 and thicknesses of the upper muleshoe 27 and bottom muleshoe 32. Orienting profile 38 may be seen as analogous to rifling in a gun barrel, such that orienting profile 38 encourages azimuthal rotation in response to longitudinal movement of a tool passing through the interior of orienting assembly 15.

Figure 3:
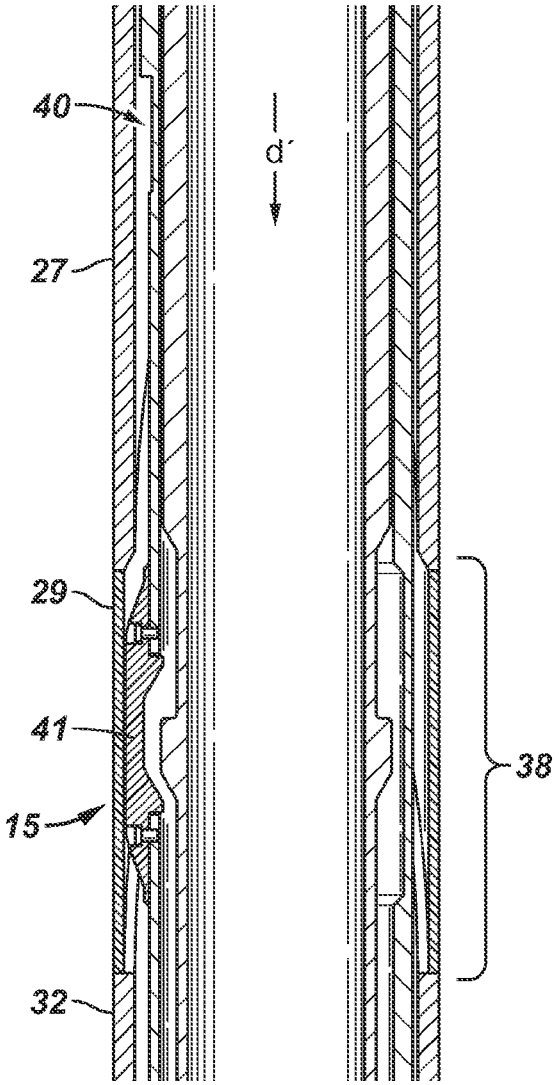
FIG. 3 is an illustration of another embodiment of an orienting assembly, according to an embodiment of the disclosure.

FIG. 3 shows a partial view of an embodiment of orienting assembly 15 interfacing with a tool 40, for instance a landing tool, passing through it. Coupling portion 21 is not shown to facilitate viewing of other embodiment elements. Passing through is understood to mean moving in a longitudinal direction with respect to the orienting tool, for instance, moving in indicated direction d'. Landing tool 40 may comprise a key portion 41, which is suitable to engage with orienting profile 38 as tool 40 passes through orienting assembly 15. In some embodiments, key portion 41 may be biased to better engage with orienting profile 38 when key portion comes in contact with the profile. Once key portion 41 is engaged with orienting profile 38 any further longitudinal movement of tool 40 (e.g. in direction d') will cause an azimuthal rotation of tool 40 as key portion 41 follows the helical path of orienting profile 38. Regardless of the point at which key portion 41 engages with orienting profile 38, key portion 41 will come to reside in receiving slot 37 of the bottom muleshoe spacer 32.

Figure 4:
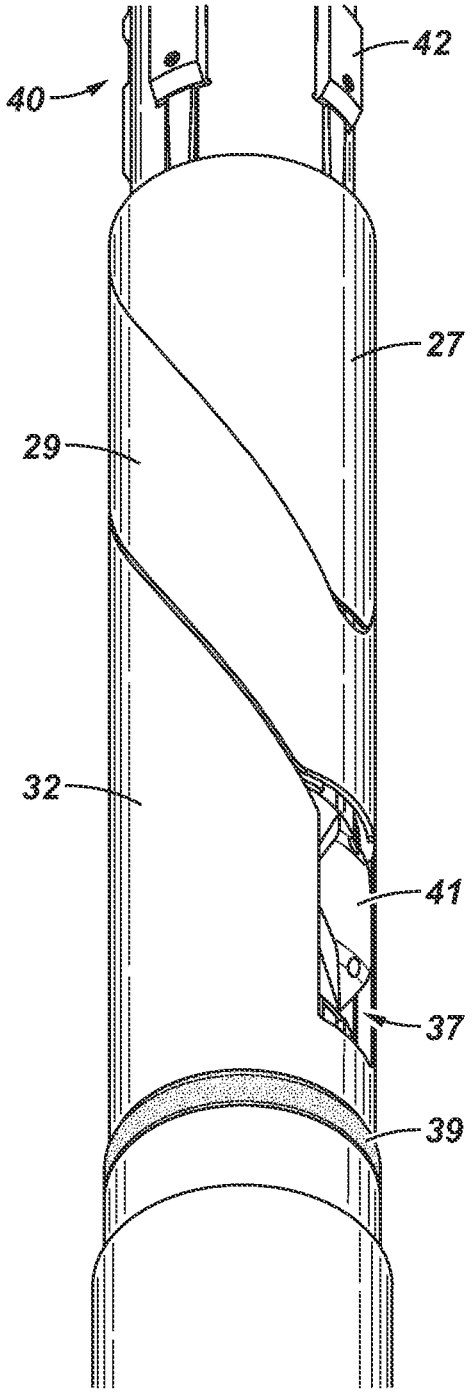
FIG. 4 is an illustration of another embodiment of an orienting assembly, according to an embodiment of the disclosure.

FIG. 4 shows a partial view of another embodiment of orienting assembly 15 interfacing with a tool 40. Coupling portion 21 is not show to facilitate viewing of other embodiment elements. Key portion 41 is shown residing receiving slot 37, as would occur after key portion 41 engages and travels through orienting profile 38, thereby orienting the tool 40 azimuthally with respect to the orienting assembly 15. Tool 40 may have locking elements 42 (e.g. collets), which could be suitable to engage and lock with the landing profile 24 of the coupling portion 21 after or concurrently with the key portion 41 entering the receiving slot 37.

In some embodiments, the orienting assembly 15 described herein contains no welded connections between any of its parts (e.g. coupling portion, muleshoe, muleshoe spacer, bottom muleshoe, etc). Orienting assembly 15 is held together through the threaded connection between threaded portions 25 and 35, and by the torque shoulder 36. Lack of welded connections may allow for use of orienting assembly 15 in harsh well conditions where welded connections are disfavored, for example in sour wells where the NACE standards disfavor usage of welded components.

While a limited number of embodiments been described, those skilled in the art, having the benefit of this disclosure, will appreciate numerous modifications and variations there from. It is intended that the appended claims cover all such modifications and variations.

What is claimed is:

1. An apparatus for a multi-lateral wellbore comprising: a locating and orientation assembly, the assembly further comprising:

a coupling portion comprising a landing profile disposed on an inner surface of the coupling portion;

an upper muleshoe;

a muleshoe spacer;

a bottom muleshoe, wherein the bottom muleshoe connects to the coupling portion through a threaded connection;

an orienting profile formed by the upper muleshoe, the muleshoe spacer, and the bottom muleshoe, disposed on the interior of the assembly to azimuthally orient a tool passing through the assembly, wherein the muleshoe spacer has an at least partially helical cross-sectional shape suitable to align the upper muleshoe with the bottom muleshoe in order to form the orienting profile.

2. The apparatus of claim 1, wherein the muleshoe spacer is disposed between the upper muleshoe and the bottom muleshoe.

3. The apparatus of claim 1, further comprising a receiving slot to receive a key portion of the tool passing through the assembly.

4. The apparatus of claim 3, wherein the orienting profiled orients the tool so that the receiving slot may receive the key portion of the tool.

5. The apparatus of claim 1, wherein the orienting profile is formed by variations in thickness between the upper muleshoe, the muleshoe spacer and the bottom muleshoe.

6. The apparatus of claim 1, wherein the upper muleshoe and the muleshoe spacer are located completely within the coupling portion.

7. The apparatus of claim 6, wherein at least the portion of the bottom muleshoe which forms the orienting profile is located within the coupling portion.

8. The apparatus of claim 1, further comprising a torque shoulder on the bottom muleshoe, the torque shoulder engaging with the coupling portion after the coupling portion and the bottom muleshoe are sufficiently threaded together.

9. The apparatus of claim 1, where the coupling portion, the upper muleshoe, the muleshoe spacer and the bottom muleshoe are not welded to each other.

10. The apparatus of claim 1, wherein the length of the threaded connection between the coupling portion and the lower muleshoe is sufficient to minimize the make-up distance between the assembly components.

11. The apparatus of claim 1, wherein the length of the threaded connection between the coupling portion and the bottom muleshoe is sufficient to minimize the freedom of movement for the upper muleshoe and the muleshoe spacer.

12. The apparatus of claim 1, further comprising a torque shoulder on the bottom muleshoe, the torque shoulder engaging with the coupling portion after the coupling portion and the bottom muleshoe are sufficiently threaded together.

13. The apparatus of claim 1, where the coupling portion, the upper muleshoe, the muleshoe spacer and the bottom muleshoe are not welded to each other.

14. The apparatus of claim 1, wherein the length of the threaded connection between the coupling portion and the lower muleshoe is sufficient to minimize the make-up distance between the assembly components.

15. The apparatus of claim 1, wherein the length of the threaded connection between the coupling portion and the bottom muleshoe is sufficient to minimize the freedom of movement for the upper muleshoe and the muleshoe spacer.

16. A method for locating and orienting in a multi-lateral wellbore, the method comprising providing locating and orientation assembly comprising:

providing a coupling portion comprising a landing profile disposed on an inner surface of the coupling portion;

inserting an upper muleshoe into the coupling portion;

inserting a muleshoe spacer into the coupling portion, the muleshoe spacer inserted to matingly contact the upper muleshoe portion;

inserting at least a portion of a bottom muleshoe into the coupling portion, the bottom muleshoe inserted to matingly contact the muleshoe spacer;

joining the coupling portion to the bottom muleshoe through a threaded connection; and forming an orienting profile on the interior of the orientation assembly through the configuration of the upper muleshoe, the muleshoe spacer, and the bottom muleshoe.

17. The method of claim 16, further comprising providing a torque shoulder on the bottom muleshoe, wherein the coupling portion abuts the torque shoulder when the bottom muleshoe and the coupling portion are properly threaded together.

18. The method of claim 16, wherein the muleshoe spacer comprises an at least partially helical cross sectional shape, the helical cross sectional shape suitable to align the upper muleshoe with the bottom muleshoe in order to form the orienting profile.

19. The method of claim 16, further comprising providing a receiving slot in the bottom muleshoe, the receiving slot suitable to receive a key portion of a tool passing through the assembly.

20. An apparatus for a multi-lateral wellbore comprising:

a locating and orientation assembly, the assembly further comprising:

a coupling portion comprising a landing profile disposed on an inner surface of the coupling portion;

an upper muleshoe;

a muleshoe spacer;

a bottom muleshoe, wherein the bottom muleshoe connects to the coupling portion through a threaded connection;

an orienting profile disposed on the interior of the assembly to azimuthally orient a tool passing through the assembly; and a receiving slot to receive a key portion of the tool passing through the assembly.

21. The apparatus of claim 20, wherein the muleshoe spacer is disposed between the upper muleshoe and the bottom muleshoe.

22. The apparatus of claim 20, wherein the orienting profile is formed by the upper muleshoe, the muleshoe spacer, and the bottom muleshoe.

23. The apparatus of claim 22, wherein the upper muleshoe and the muleshoe spacer are located completely within the coupling portion.

24. The apparatus of claim 23, wherein at least the portion of the bottom muleshoe which forms the orienting profile is located within the coupling portion.

25. The apparatus of claim 20, wherein the orienting profile is formed by variations in thickness between the upper muleshoe, the muleshoe spacer and the bottom muleshoe.

26. The apparatus of claim 20, wherein the orienting profiled orients the tool so that the receiving slot may receive the key portion of the tool.

27. The apparatus of claim 20, further comprising a torque shoulder on the bottom muleshoe, the torque shoulder engaging with the coupling portion after the coupling portion and the bottom muleshoe are sufficiently threaded together.

28. The apparatus of claim 20, where the coupling portion, the upper muleshoe, the muleshoe spacer and the bottom muleshoe are not welded to each other.

29. The apparatus of claim 20, wherein the length of the threaded connection between the coupling portion and the lower muleshoe is sufficient to minimize the make-up distance between the assembly components.

30. The apparatus of claim 20, wherein the length of the threaded connection between the coupling portion and the bottom muleshoe is sufficient to minimize the freedom of movement for the upper muleshoe and the muleshoe spacer.

31. An apparatus for a multi-lateral wellbore comprising:

a locating and orientation assembly, the assembly further comprising:

a coupling portion comprising a landing profile disposed on an inner surface of the coupling portion;

an upper muleshoe;

a muleshoe spacer;

a bottom muleshoe, wherein the bottom muleshoe connects to the coupling portion through a threaded connection; and an orienting profile disposed on an interior of the assembly to azimuthally orient a tool passing through the assembly, the orienting profile formed by variations in thickness between the upper muleshoe, the muleshoe spacer, and the bottom muleshoe.

32. The apparatus of claim 31, wherein the muleshoe spacer is disposed between the upper muleshoe and the bottom muleshoe.

33. The apparatus of claim 31, wherein the orienting profile is formed by the upper muleshoe, the muleshoe spacer, and the bottom muleshoe.

34. The apparatus of claim 33, wherein the upper muleshoe and the muleshoe spacer are located completely within the coupling portion.

35. The apparatus of claim 34, wherein at least the portion of the bottom muleshoe which forms the orienting profile is located within the coupling portion.

36. The apparatus of claim 31, further comprising a receiving slot to receive a key portion of the tool passing through the assembly and wherein the orienting profile orients the tool so that the receiving slot may receive the key portion of the tool.

37. A method for locating and orienting in a multi-lateral wellbore, the method comprising providing locating and orientation assembly comprising:

providing a coupling portion comprising a landing profile disposed on an inner surface of the coupling portion;

inserting an upper muleshoe into the coupling portion;

inserting a muleshoe spacer into the coupling portion, the muleshoe spacer inserted to matingly contact the upper muleshoe portion;

inserting at least a portion of a bottom muleshoe into the coupling portion, the bottom muleshoe inserted to matingly contact the muleshoe spacer;

joining the coupling portion to the bottom muleshoe through a threaded connection; and providing a receiving slot in the bottom muleshoe, the receiving slot suitable to receive a key portion of a tool passing through the assembly.

38. The method of claim 37, further comprising providing a torque shoulder on the bottom muleshoe, wherein the coupling portion abuts the torque shoulder when the bottom muleshoe and the coupling portion are properly threaded together.

39. The method of claim 37, further comprising forming an orienting profile on the interior of the orientation assembly through the configuration of the upper muleshoe, the muleshoe spacer and the bottom muleshoe.

40. The method of claim 39, wherein the muleshoe spacer comprises an at least partially helical cross sectional shape, the helical cross sectional shape suitable to align the upper muleshoe with the bottom muleshoe in order to form the orienting profile.

* * * * *